United States Patent [19]

Hilbert et al.

[11] 4,170,716

[45] Oct. 9, 1979

[54] AM STEREO RECEIVER WITH CORRECTION LIMITING

[75] Inventors: Francis H. Hilbert, Addison; Norman W. Parker, Wheaton, both of Ill.

[73] Assignee: Motorola, Inc., Schaumburg, Ill.

[21] Appl. No.: 842,026

[22] Filed: Oct. 14, 1977

[51] Int. Cl.[2] ..... H04H 5/00

[52] U.S. Cl. ..... 179/1 GS

[58] Field of Search ..... 179/15 BT, 1 GS; 325/36, 60, 456

[56] References Cited

U.S. PATENT DOCUMENTS

| | | | |
|---|---|---|---|
| 3,068,475 | 12/1962 | Avins | 179/15 BT |
| 3,080,453 | 3/1963 | Avins | 179/15 BT |
| 3,534,172 | 10/1970 | Weeda | 179/15 BT |
| 3,823,268 | 7/1974 | Modafferi | 179/15 BT |
| 4,018,994 | 4/1977 | Kahn | 179/15 BT |
| 4,037,057 | 7/1977 | Ogita et al. | 179/15 BT |

*Primary Examiner*—Douglas W. Olms

*Attorney, Agent, or Firm*—Margaret March Parker; James W. Gillman

[57] ABSTRACT

An AM receiver receiving a compatible stereo signal and utilizing a cosine correction signal for restoring the original stereo information limits the amount of correction at very large modulation angles to prevent excessive noise from being introduced by the increased gain.

6 Claims, 3 Drawing Figures

AM STEREO RECEIVER WITH CORRECTION LIMITING

BACKGROUND OF THE INVENTION

Since any AM stereo broadcast signal must be a compatible signal, i.e., provide undistorted monophonic or L+R reception by monophonic receivers, an ideal system would have only sum or monophonic information on the envelope, but would provide sufficient information for accurate stereo reproduction in stereo receivers. This has been done in a system disclosed in a co-pending application, Ser. No. 674,703, assigned to the same assignee as is the present invention. In this system, a carrier is modulated in quadrature with information corresponding to the sum and difference of left and right information. After modulation, the carrier is limited to eliminate amplitude variation, but retain the quadrature phase information. The carrier is then amplitude modulated by the sum or monophonic signal in a power amplifier stage and broadcast in the form $1+(L+R)\cos(\omega_c t+\phi)$ where $\phi$ is arc tan $[(L-R)/(1+L+R)]$. In a monophonic receiver, the L+R information can easily be recovered by an envelope detector but for undistorted stereo, a division by $\cos\phi$ is needed in a stereo receiver. Depending on receiver design, $\cos\phi$ division may be done once or twice and in any of a number of points in the receiver circuit. However, if the angle $\phi$ becomes very large, the cosine becomes very small and division by the cosine factor causes the gain in the corrected channel to increase rapidly; e.g., when $\phi$ goes from 75° to 85°, the unlimited gain would almost triple ($1/\cos\phi$ going from 3.9 to 11.5). Thus, at very large values of $\phi$, it is advisable to allow a small amount of distortion in order to prevent a large decrease in S/N ratio.

SUMMARY OF THE INVENTION

It is therefore an object of the present invention to provide a satisfactory S/N ratio in a compatible AM stereo receiver.

It is a particular object to accomplish the above by limiting the amount of correction at very large angles of modulation in the L−R channel.

The above objects are achieved in a receiver constructed in accordance with the present invention and wherein a cosine correction factor is derived from a received signal. Before the correction factor is applied to the received signal or any signal derived therefrom, the level of the cosine factor is controlled so that the gain of the channel being corrected is limited to suitable values. Maximum desirable gain due to the correction factor would be on the order of 4 to 6.

DETAILED DESCRIPTION OF THE PREFERRED EMBODIMENT

Figure 1:
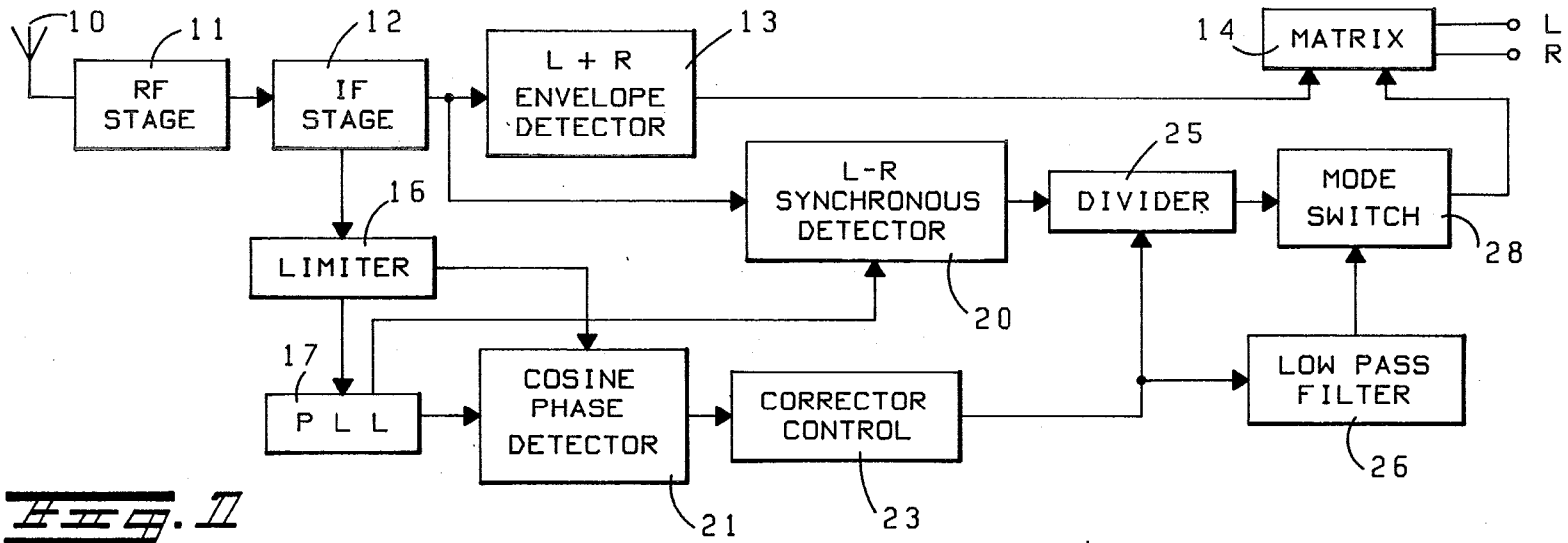
FIG. 1 is a block diagram of the receiver embodying the invention.

In FIG. 1, the invention is shown embodied in a receiver similar in principle to a receiver disclosed in a co-pending application, Ser. No. 837,258, assigned to the same assignee as is the present invention. Application of the invention to this particular receiver is to be considered exemplary only. In this receiver, a signal having the form $(1+L+R)\cos(\omega_c t+\phi)$ where $\phi$ is arc tan $[(L-R)/(1+L+R)]$, is received by an antenna 10, RF stage 11 and IF stage 12, which may be of any normal design. One IF output is processed in an envelope detector 13 to provide a sum (L+R) signal from the amplitude modulation on the received carrier. The sum signal may be coupled directly to a matrix 14 where it is combined with the difference signal to produce the original left (L) and right (R) signals. It is to be noted that "L" and "R" or "left" and "right" are used throughout this description only as exemplary of any two signals which might be transmitted on a AM carrier.

Another output of the IF stage 12 is coupled to a limiter 16 where amplitude variations are removed. The output of the limiter 16 is thus an IF signal having the phase modulation of the transmitted quadrature signal. The limiter 16 is coupled to a phase locked loop (PLL) 17 which provides a signal having the frequency of the original transmitter oscillator. The normal $\sin\omega_c t$ output signal of the PLL 17 is coupled to a synchronous detector 20 which also receives the IF stage 12 output. The detector 20 output is a signal proportional to $(L-R)\cos\phi$, derived as follows. The synchronous detector 20 is likewise a multiplier such as is known in the art, and multiplies the output signal from the IF stage 12 $(1+L+R)\cos(\omega_c t+\phi)$ by the $\sin\omega_c t$ output of the PLL 17. This product would then be $(1+L+R)[\sin(2\omega_c t+\phi)+\sin\phi]$. Disregarding the double frequency term, this becomes $(1+L+R)\sin\phi$ where $\phi$ is arc tan $[(L-R)/(1+L+R)]$. The sine of the angle $\phi$ is then $(L-R)/\sqrt{(L-R)^2+(1+L+R)^2}$ and the cosine of this angle is $(1+L+R)/\sqrt{(L-R)^2+(1+L+R)^2}$. Substituting the sine of the angle in the signal as given above we obtain $(1+L+R)(L-R)/\sqrt{(L-R)^2+(1+L+R)^2}$ which equals $(L-R)\cos\phi$. A cosine phase detector 21 receives a $\cos(\omega_c t+\phi)$ output of the limiter 16 and a (phase-shifted) $\cos\omega_c t$ output from the PLL 17, and provides an output proportional to the cosine of the angle $\phi$. The cosine phase detector 21 is a multiplier of a type such as the Motorola MC1595 four quadrant multiplier. This output signal is termed the cosine correction signal since its purpose is to correct the received signal in such a fashion as to restore the original stereo signals. A cosine correction signal is, under normal conditions, coupled through a corrector control 23 to a divider 25 and a low pass filter 26. In the divider 25 the output of the sychronous detector 20, which is $(L-R)\cos\phi$, is divided by the cosine correction signal, which is proportional to $\cos\phi$, to produce the difference signal (L−R). In the low pass (2–10 Hz) filter 26, the DC level of the correction signal is established and coupled to operate a mode switch 28. When and only when the DC level is sufficiently high, indicating stereo transmission, the mode switch will be activated to couple the divider 25 output to the matrix 14. Other signals may be included in the broadcast signal to provide an indication of the presence of stereo transmission and to activate the mode switch and other circuitry as fully described in co-pending application Ser. No. 837,256, assigned to the same assignee as is the present invention.

Figure 2:
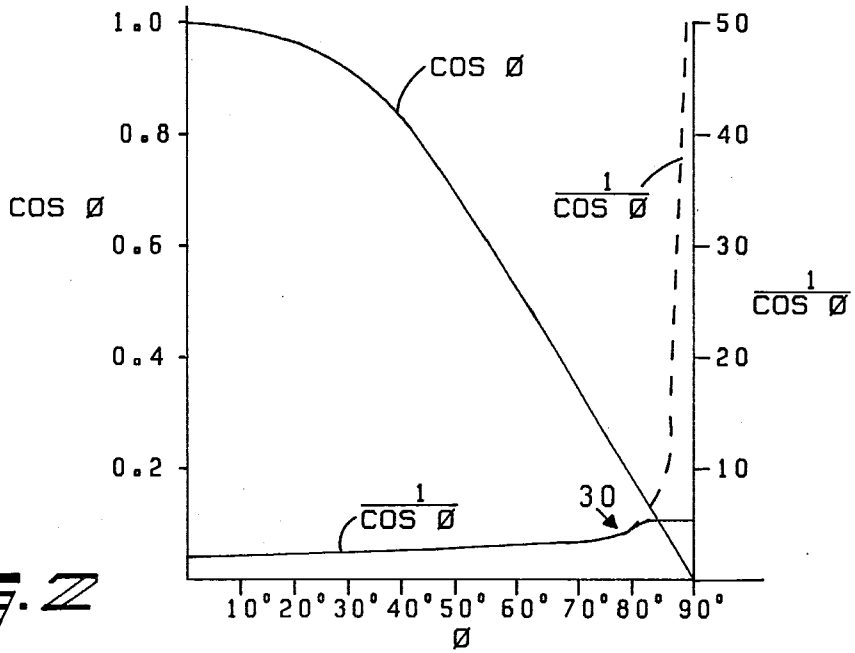
FIG. 2 is a graph for demonstrating a portion of the invention.
Figure 3:
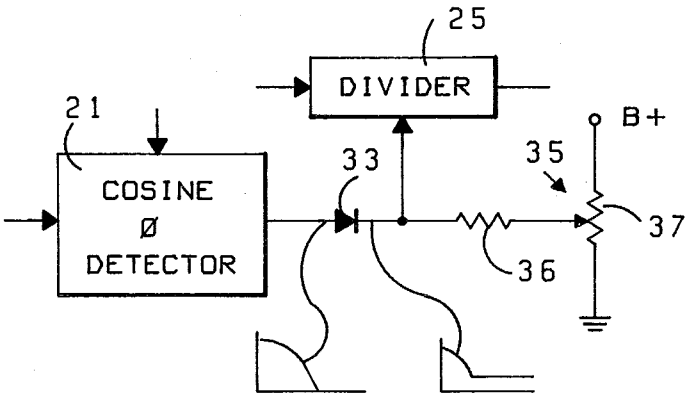
FIG. 3 is a block diagram of the correction control circuit of FIG. 1.

The corrector control 23, which is more fully described in relation to FIGS. 2 and 3, serves to prevent a decrease in S/N ratio due to greatly increased gain when the modulation angle $\phi$ is very large. When the difference signal (L−R) is small, $\phi$ is near 0 and cos $\phi$ is near 1. As the difference signal increases, the cosine correction signal is reduced. Division by the lowered signal increases the gain to eliminate distortion in the stereo receiver. At large modulation angles, i.e., $\phi > 65°$, the cosine correction signal decreases rapidly, and the gain of the channel increases rapidly. Since the S/N ratio decreases when the gain is larger, it is desirable to limit the gain due to the correction signal to a maximum of 4 to 6 (maximum cosine signal 0.25 to 0.16). The very slight amount of distortion introduced by limiting the amount of correction at large modulation angles is preferable to the excess noise which would otherwise be introduced as $\phi$ approached 90° and the gain was very greatly increased.

FIG. 2 is a chart of the angle $\phi$ in degrees vs. cos $\phi$ and 1/cos $\phi$ (or sec $\phi$). As is known, when $\phi$ goes from 0° to 90°, the cosine value goes from 1 to 0, and the inverse or 1/cos $\phi$ goes from 1 to $\infty$. As shown, however, the inverse does not exceed six until $\phi$ exceeds 80°. It is, therefore, not necessary or desirable to control the value of the cosine correction signal until $\phi$ exceeds 75° to 80°. As indicated on the graph of 1/cos $\phi$, the values increase sharply beyond a point 30, and since the gain of the L−R channel is proportional to the instantaneous value of 1/cos $\phi$, the S/N ratio would be sharply decreased beyond point 30. In accordance with the invention, the value of the cos $\phi$ correction signal is prevented from going below a set value in the range 0.25 to 0.167. It will be recognized that no units of measurement are given since these values are proportional to the value of the correction signal when $\phi$ is zero.

FIG. 3 shows a simplified circuit diagram indicating one circuit arrangement for embodying the invention. The output of the cosine detector 21 is coupled through a diode 33 to the divider 25. Also coupled to the diode 33 is a reference source 35 which may consist of a resistor 36 and potentiometer 37, the potentiometer being coupled between a supply voltage and ground. In this arrangement, the signal on the plus side of the diode 33 would be, as indicated, proportional to the cosine of the modulation angle $\phi$. With a reference signal established on the low side of the diode 33, the signal coupled to the divider 25 will be prevented from going below the value of the reference signal. It will be apparent that such a limiting condition could be established by other, equivalent arrangements. The reference signal could also be a fixed level signal.

Thus there has been shown and described an arrangement for preventing possible degradation of the S/N ratio in a compatible AM stereo receiver as the modulation angle approaches 90°. It is intended to cover all modifications and variations thereof which fall within the spirit and scope of the appended claims.

What is claimed is:

1. In an AM stereo receiver for receiving signals of the form $(1+L+R)\cos(\omega_c t+\phi)$ where $\phi$ is arc tan $\{(L-R)/(1+L+R)\}$, L and R represent first and second program information signals, and $\omega_c t$ is a carrier frequency, and requiring a cos $\phi$ correction signal to restore the stereo information, a corrector control arrangement comprising in combination;

input means for receiving the broadcast signal and deriving therefrom an intermediate frequency signal;

means for detecting stereo information in the intermediate frequency signal;

means coupled to the input means for deriving a correction signal which is a function of the cosine of the angle of modulation;

control means coupled to limit the range of values of the correction signal.

2. An AM stereo receiver in accordance with claim 1 and wherein the allowed range of values corresponds to values of the modulation angle $0° \leqq \phi \leqq 80°$.

3. An AM stereo receiver in accordance with claim 1 and wherein the control means includes reference means for establishing a reference signal and means for maintaining the value of the second correction signal at the level of the reference signal when the first correction signal is less than said reference signal.

4. An AM stereo receiver in accordance with claim 1 and further including means for dividing at least a portion of the stereo information by the correction signal.

5. An AM stereo receiver in accordance with claim 4 and wherein the portion of the stereo information is proportional to (L−R) cos $\phi$ and the output of the divider means is proportional to (L−R).

6. An AM stereo receiver in accordance with claim 1 wherein the correction signal is proportional to cosine of the angle of modulation.

* * * * *